US009394890B2

(12) United States Patent
Feckler et al.

(10) Patent No.: US 9,394,890 B2
(45) Date of Patent: Jul. 19, 2016

(54) RECIPROCATING-PISTON PUMP WITH PLAIN BEARING TRAVERSED BY FLOW

(71) Applicant: Thomas Magnete GmbH, Herdorf (DE)

(72) Inventors: Michael Feckler, Herdorf (DE); Mike Heck, Derschen (DE); Axel Muller, Siegen (DE); Olaf Ohligschlager, Grunebach (DE); Tebea Reinschmidt, Neunkirchen (DE); Robert Wellnitz, Kirchen (DE)

(73) Assignee: Thomas Magnete GmbH, Herdorf (DE)

( * ) Notice: Subject to any disclaimer, the term of this patent is extended or adjusted under 35 U.S.C. 154(b) by 513 days.

(21) Appl. No.: 13/851,282

(22) Filed: Mar. 27, 2013

(65) Prior Publication Data

US 2013/0280103 A1 Oct. 24, 2013

(30) Foreign Application Priority Data

Apr. 3, 2012 (DE) ..... 10 2012 006 782

(51) Int. Cl.

| | |
|---|---|
| ***F04B 17/03*** | (2006.01) |
| ***F04B 17/04*** | (2006.01) |
| *F04B 39/06* | (2006.01) |
| *F04B 39/02* | (2006.01) |

(52) U.S. Cl.

CPC ..... *F04B 17/03* (2013.01); *F04B 17/046* (2013.01); *F04B 39/02* (2013.01); *F04B 39/0276* (2013.01); *F04B 39/06* (2013.01)

(58) Field of Classification Search

CPC ..... F04B 17/03; F04B 17/04; F04B 17/046; F04B 17/048; F04B 35/04; F04B 35/045; F04B 39/0005; F04B 39/02; F04B 39/0223; F04B 39/0276; F04B 39/06; F04B 53/08; F04B 53/14; F04B 1/143; F02M 57/02; F02D 41/0025; F16N 13/20

USPC ..... 417/252, 416, 501

See application file for complete search history.

(56) References Cited

U.S. PATENT DOCUMENTS

| | | | |
|---|---|---|---|
| 1,396,296 | A | 11/1921 | Springer |
| 2,231,861 | A | 2/1941 | Adams |

(Continued)

FOREIGN PATENT DOCUMENTS

| | | | |
|---|---|---|---|
| DE | 1301956 | B | 8/1969 |
| DE | 4328621 | A1 | 3/1995 |

(Continued)

*Primary Examiner* — Bryan Lettman
*Assistant Examiner* — Connor Tremarche
(74) *Attorney, Agent, or Firm* — Harness, Dickey & Pierce, P.L.C.

(57) ABSTRACT

A reciprocating-piston pump with plain bearing traversed by flow. The reciprocating-piston pump is driven by an electromagnet to have a bearing of the piston in a cylinder, which bearing is protected against local overheating and from which bearing decomposition and reaction products and any wear products generated are discharged. For this purpose, elongate helical depressions are provided in one of two bearing surfaces in a bearing gap between the piston and the cylinder, which depressions are traversed entirely or partially by a flow of the liquid which is delivered by the piston acting in interaction with other components of the reciprocating-piston pump for the delivery rate of the reciprocating-piston pump. Reciprocating-piston pumps of the described type can be used as dosing pumps and as delivery pumps in fuel-operated standstill heaters, auxiliary heaters and exhaust-gas purification systems in vehicles.

7 Claims, 5 Drawing Sheets

(56) References Cited

U.S. PATENT DOCUMENTS

| | | | | | |
|---|---|---|---|---|---|
| 2,337,821 | A | * | 12/1943 | Huber | F04B 1/143 74/60 |
| 2,371,846 | A | | 3/1945 | Ruthven | |
| 2,371,848 | A | | 3/1945 | Schulze | |
| 2,937,659 | A | | 5/1960 | Harris et al. | |
| 2,953,993 | A | * | 9/1960 | Strickland | F16N 13/20 310/86 |
| 3,153,897 | A | | 10/1964 | Kummerer et al. | |
| 3,153,987 | A | | 10/1964 | Thoma | |
| 4,644,851 | A | | 2/1987 | Young | |
| 5,140,905 | A | | 8/1992 | Dhar | |
| 5,357,933 | A | * | 10/1994 | Kasahara | F02M 57/02 123/446 |
| 7,607,422 | B2 | * | 10/2009 | Carlson | F02D 41/0025 123/478 |

FOREIGN PATENT DOCUMENTS

| | | | |
|---|---|---|---|
| DE | 102011111926 | A1 | 2/2013 |
| JP | 2002-039057 | A | 2/2002 |

* cited by examiner

RECIPROCATING-PISTON PUMP WITH PLAIN BEARING TRAVERSED BY FLOW

CROSS-REFERENCE TO RELATED APPLICATIONS

This application claims the benefit and priority of German Patent Application No. 10 2012 006 782.8, filed Apr. 3, 2012. The entire disclosure of the above application is incorporated herein by reference.

FIELD

The present disclosure relates to a reciprocating-piston pump driven by an electromagnet.

BACKGROUND

This section provides background information related to the present disclosure which is not necessarily prior art.

Reciprocating-piston pumps which are driven by electromagnets and which serve for delivering and dosing fuel are known for example from DE 4328621 and DE 10 2001 111 926 and have been tried and tested.

With the proliferation of fuels with a relatively high fraction of contents not based on mineral oil, such as for example biodiesel or alcohols, and therefore also of water, the materials of the friction partners, in particular of the pistons and of the cylinder, have had to be adapted; nevertheless, under certain operating conditions, new wear phenomena are encountered in such dosing pumps. The wear phenomena are caused for example by local overheating in the event of a locally restricted lubrication film failure, or by the degraded lubrication properties in relation to media based purely on mineral oil.

It is known from documents U.S. Pat. No. 2,337,821 and U.S. Pat. No. 3,153,897 for grooves running both in the circumferential direction and also in the longitudinal direction to be provided on the piston surface, which grooves are suitable for improving the lubrication and, if appropriate, retaining abrasion products in the grooves. The grooves are, in part, connected to the working side of the pump piston by bores.

Documents U.S. Pat. No. 2,231,861, U.S. Pat. No. 2,371,848 and U.S. Pat. No. 5,140,905 also present pumps having axial circumferential grooves to which liquid is supplied via bores.

Document U.S. Pat. No. 2,937,659 presents a pump piston having a check valve received therein, which check valve discharges the delivered volume flow to the pressure side through grooves in the piston.

Document 4644851 presents a compressor in which the piston bearing is assisted by pressure fields to which medium is supplied from the working side of the piston.

SUMMARY

This section provides a general summary of the disclosure, and is not a comprehensive disclosure of its full scope or all of its features.

It is an object of this disclosure to conduct a liquid flow through the bearing gap between the piston and the cylinder, which liquid flow cools the bearing and discharges any decomposition and reaction products and potential wear products generated. Here, the dosing accuracy of the reciprocating-piston pump should be maintained, and the production costs should not be increased significantly.

A reciprocating-piston pump driven by an electromagnet can comprise, in addition to the necessary ports, two valves and housing components, a piston which is sealingly borne in a cylinder and which supports the armature piston of the electromagnet. The bearing exhibits very little bearing play at least in one portion in order that pressure-independent delivery and precise dosing is attained, and said bearing accommodates the transverse forces of the armature piston, wherein the armature-chamber-side bearing portion is subjected to its greatest loading when the electromagnet is energized.

For cooling the bearing and for the discharge of decomposition and reaction products and potential wear products generated, long, helical depressions, for example spiral-shaped grooves or shallow threads, are provided in at least one of the two surfaces in the bearing gap between the piston and the cylinder. Said depressions are traversed by a flow of the liquid, which is delivered in any case by the piston of the reciprocating-piston pump during the course of the displacement, because a fluid-conducting duct provided for this purpose, preferably a transverse bore in the piston, connects the check valve situated in the piston to the depressions.

In a first embodiment of the reciprocating-piston pump having a delivery from the displacement chamber to the armature chamber and having two check valves, the delivery flow of the reciprocating-piston pump is conducted entirely from one of the check valves through the transverse bore in the piston to the depressions in the surface of the piston or of the cylinder and is conducted through the armature-chamber-side bearing zone into the armature chamber, wherein the depressions extend into the armature chamber. Here, the delivery rate of the reciprocating-piston pump is not influenced or is influenced only very slightly because, between the transverse bore and the displacement body chamber, the piston seals against the cylinder. A disadvantage is however the increase in the contact pressure in the armature-chamber-side bearing zone of the cylinder.

In a second embodiment, by contrast to the first embodiment, only a part of the pump delivery flow is conducted through the transverse bore, and the rest of the delivery flow passes through the piston and through another transverse bore directly into the armature chamber, wherein the size of the transverse bores determines the apportionment of the partial flows.

In a third embodiment, the delivery flow of the reciprocating-piston pump is conducted entirely from the check valve through the first transverse bore in the piston to depressions in the surface of the piston or of the cylinder, then through the second transverse bore back into a second longitudinal bore in the piston, and then through the third transverse bore into the armature chamber. Here, said depressions do not extend into the armature chamber. In this way, the highly loaded bearing zone adjoining the armature chamber may be formed without depressions.

It is the case in this embodiment, too, that the delivery rate of the reciprocating-piston pump is not influenced or is influenced only very little by the bearing through flow. A disadvantage of this embodiment is the pressure drop across the transverse bores, because the delivery flow of the reciprocating-piston pump must pass through three transverse bores.

In a fourth embodiment, in a modification of the third embodiment, only a part of the pump delivery flow is conducted through the bearing zone, and the rest of the delivery flow is conducted through a throttling connection from the first to the second longitudinal bore, wherein firstly the size of the transverse bores and secondly the throttling connection determine the apportionment of the partial flows.

The third and fourth embodiments can be modified in that the delivery flow is conducted from the bearing zone, which is traversed by flow, to the armature chamber through a transverse bore in the cylinder and through further fluid-conducting ducts. Correspondingly to the second embodiment, a partial flow can be conducted through a transverse bore in the piston to the armature chamber, wherein, again, the size of said transverse bore determines the apportionment of the partial flows.

The embodiments described above relate to reciprocating-piston pumps which conduct the liquid flow from the inlet into the displacement body chamber and then through the armature chamber to the outlet. The technical teaching of this disclosure can however also be applied to reciprocating-piston pumps which conduct the liquid flow from the inlet into the armature chamber and then through the displacement body chamber to the outlet. This results in a different direction of the flow through the bearing, but the features of the disclosure are maintained.

The described embodiments are suitable for cooling the bearing gap between the piston and the cylinder and if appropriate additionally discharging the decomposition and reaction products and potential wear products generated. The third and fourth embodiments have, at the armature-chamber-side end of the cylinder, a bearing zone which is not interrupted by depressions. The first and second embodiments offer a low pressure-effective resistance for the liquid to be delivered.

For the operation of the reciprocating-piston pump, a controlled electrical voltage or a regulated electrical current for the electromagnet is used. The electrical supply has a pulsed profile with respect to time, wherein the frequency determines the delivery rate of the reciprocating-piston pump, the pulse-to-pause ratio is coordinated with the pressure at the outlet of the pump, and the flank gradients of the pulses are coordinated with the demands on the liquid flow through the cylinder. Here, a steep flank gradient may assist in effecting a fast change in the liquid flow, and this is advantageous for the discharge of wear products from the bearing region. For this purpose, the base frequency of the pulsed electrical power has superposed on it an additional pulse width modulation in order to adapt the present electrical power to the demand and in order to adjust the stated flank gradient. The manipulation of the flank gradient by means of the described superposed pulse width modulation may also be described as a targeted generation of suitable harmonics.

Reciprocating-piston pumps of the described type are used as dosing pumps and as delivery pumps in fuel-operated standstill heaters, auxiliary heaters and exhaust-gas purification systems in vehicles.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
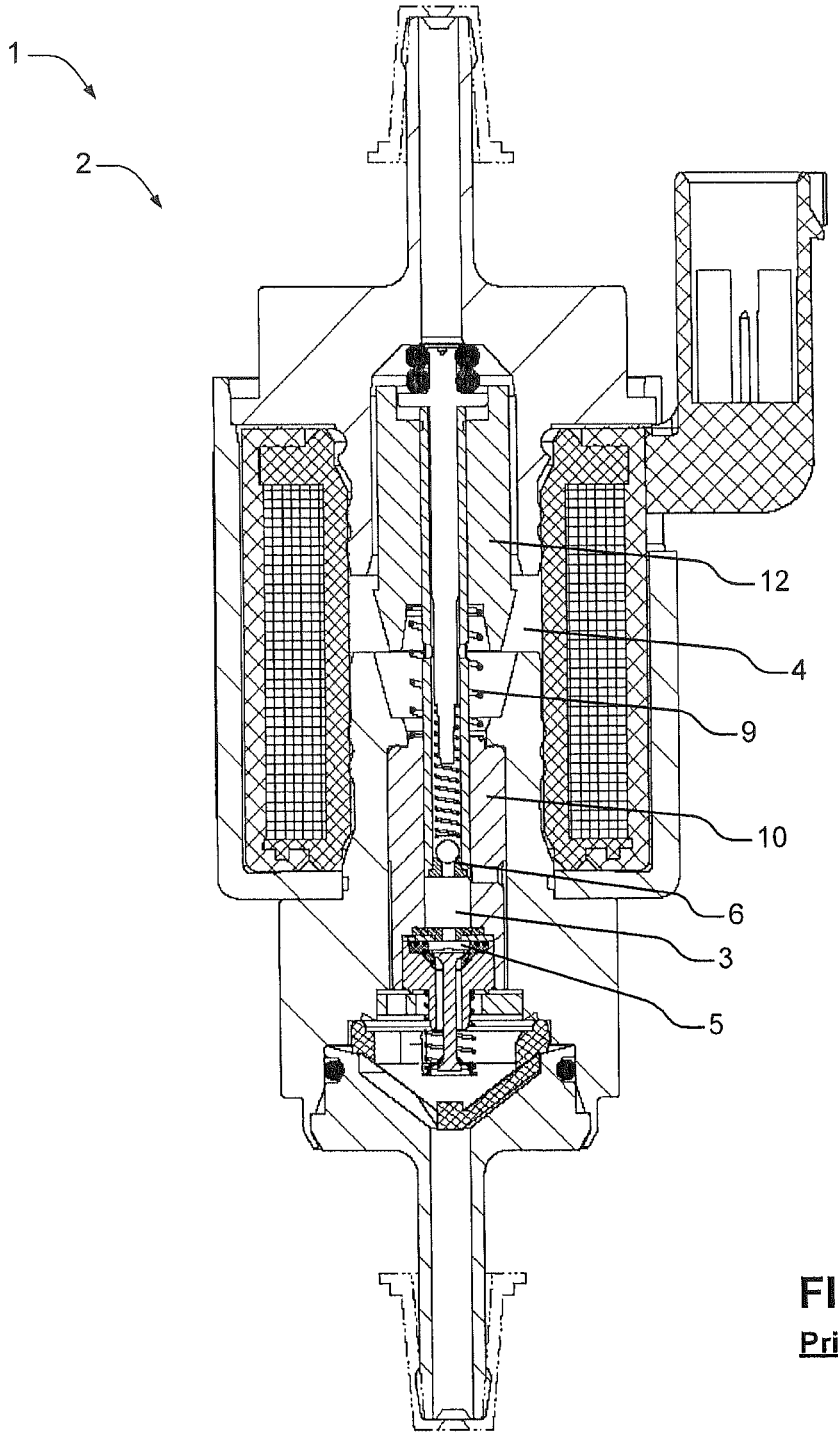
FIG. 1 Prior Art
FIG. 1 shows a dosing pump according to the prior art.

Example embodiments will now be described more fully with reference to the accompanying drawings.

The reciprocating-piston pump 1 driven by an electromagnet 2 comprises two check valves 5 and 6 and also a piston 9 which is sealingly borne in a cylinder 10 and which supports the armature piston 12 of the electromagnet 2.

Figure 2:
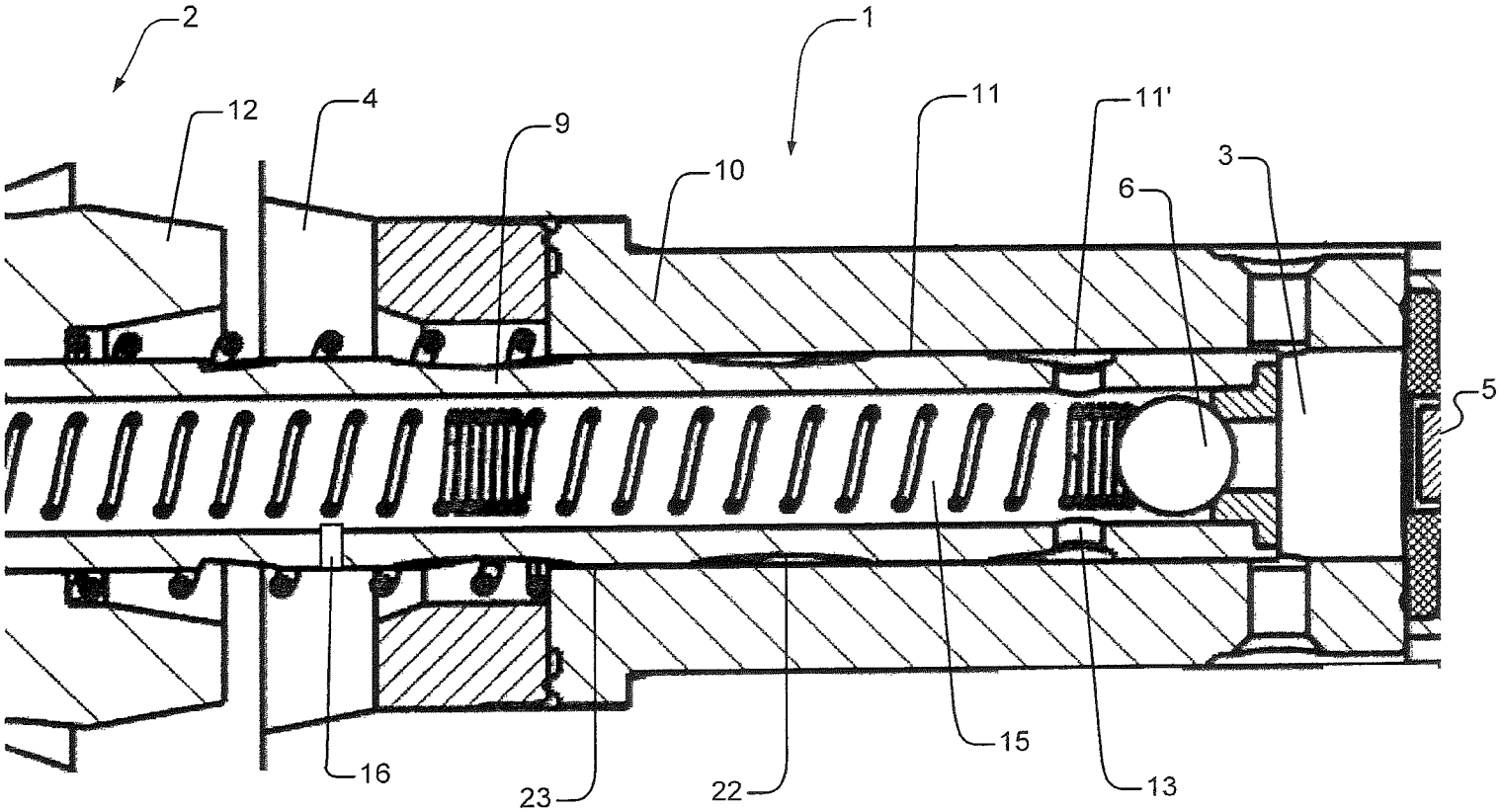
FIG. 2 shows the reciprocating-piston pump of the first or second embodiment with a transverse bore close to the valve.

FIG. 2 shows that elongate depressions 11' are provided in one of the two surfaces in the bearing gap 11 between the piston 9 and the cylinder 10, which depressions are traversed by a flow of the delivered liquid. For this purpose, a transverse bore 13 produces a connection from the valve 6 to the bearing gap 11.

In a first and second embodiment according to FIG. 2, the delivery flow of the reciprocating-piston pump 1 is conducted entirely or partially from the valve 6 through the transverse bore 13 to the depressions 11' in the surface of the piston 9 or of the cylinder 10 and is conducted through the bearing zones 22 and 23 into the armature chamber 4, wherein the depressions 11' extend into the armature chamber 4 but do not extend into the displacement chamber 3.

The second embodiment differs from the first in that only a part of the delivery flow is conducted through the bearing gap 11, wherein the remaining partial amount of the delivery flow is conducted through the transverse bore 16 into the armature chamber 4.

Figure 3:
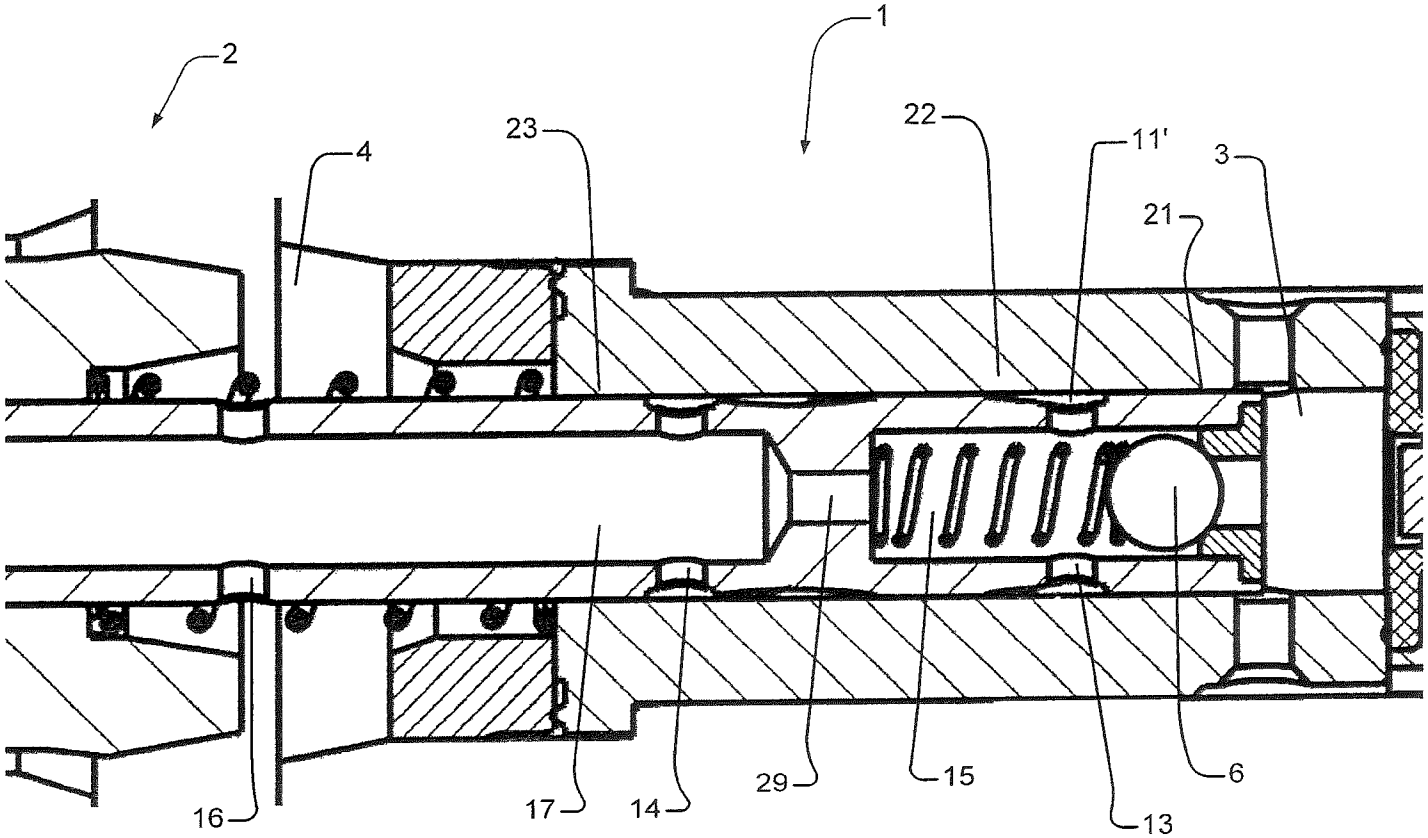
FIG. 3 shows the reciprocating-piston pump of the third or fourth embodiment with three transverse bores in the piston.

In a third and fourth embodiment according to FIG. 3, the delivery flow of the reciprocating-piston pump 1 is conducted entirely or partially from the valve 6 through the transverse bore 13 to depressions 11' in the surface of the piston 9 or of the cylinder 10, then through the transverse bore 14 into the longitudinal bore 17 of the piston, and then through the transverse bore 16 into the armature chamber 4. The depressions 11' do not extend into the armature chamber 4 and do not extend into the displacement body chamber 3.

In the fourth embodiment, by contrast to the third embodiment, the delivery flow of the reciprocating-piston pump 1 is conducted only partially through the bearing zone 22, because a partial amount of the delivery flow flows out of the longitudinal bore 15 through the bore 29 into the second longitudinal bore 17.

Figure 4:
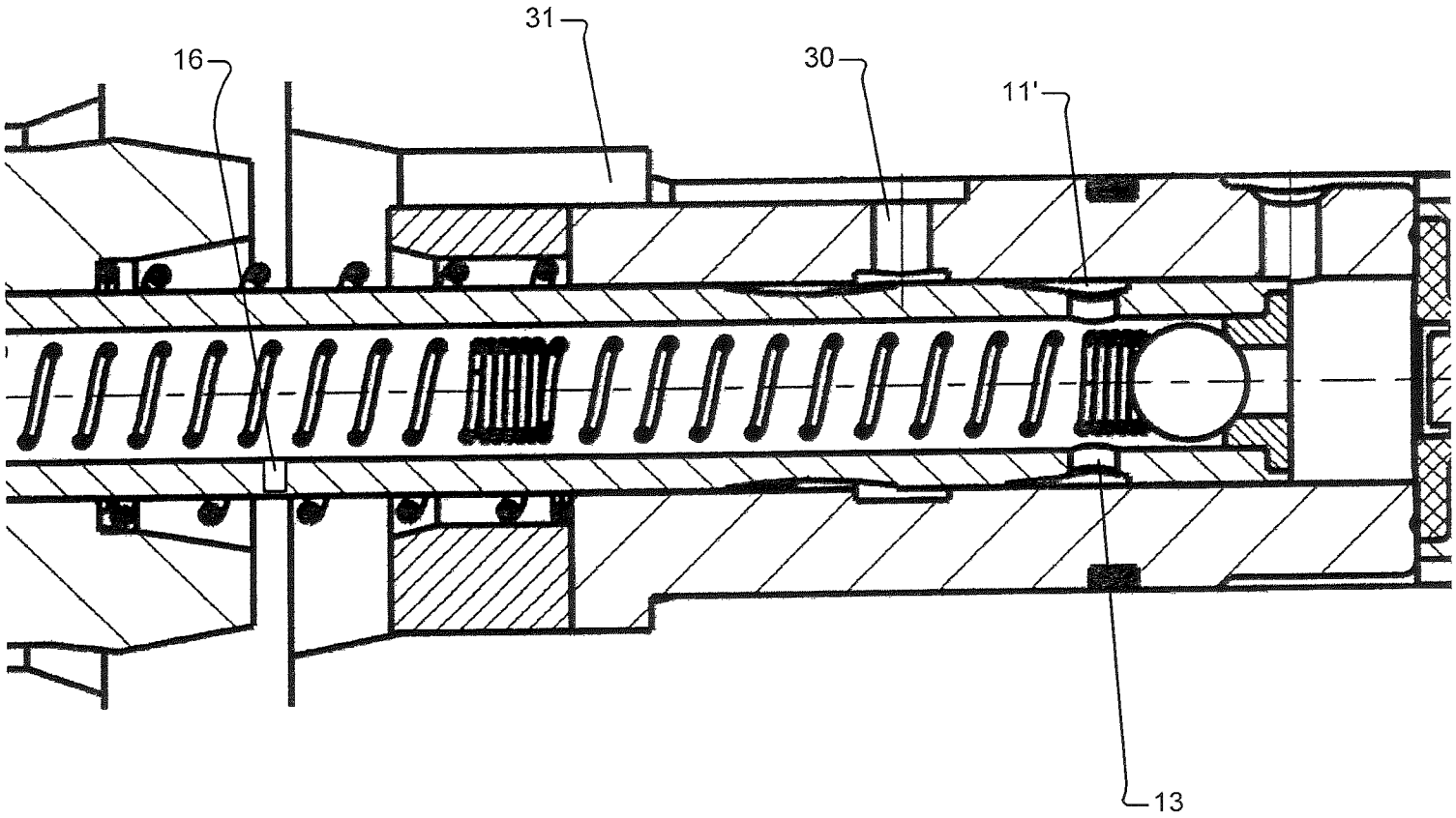
FIG. 4 shows the reciprocating-piston pump with a transverse bore in the cylinder.

The third and fourth embodiments can be modified, as per FIG. 4, in that the delivery flow is conducted from the bearing zone 22, which is traversed by flow, to the armature chamber 4 through a transverse bore 30 in the cylinder 10 and through further fluid-conducting ducts 31. Correspondingly to the second embodiment, a partial flow can be conducted through a transverse bore 16 in the piston 9 to the armature chamber 4, wherein the size of said transverse bore 16 determines the apportionment of the partial flows.

Figure 5:
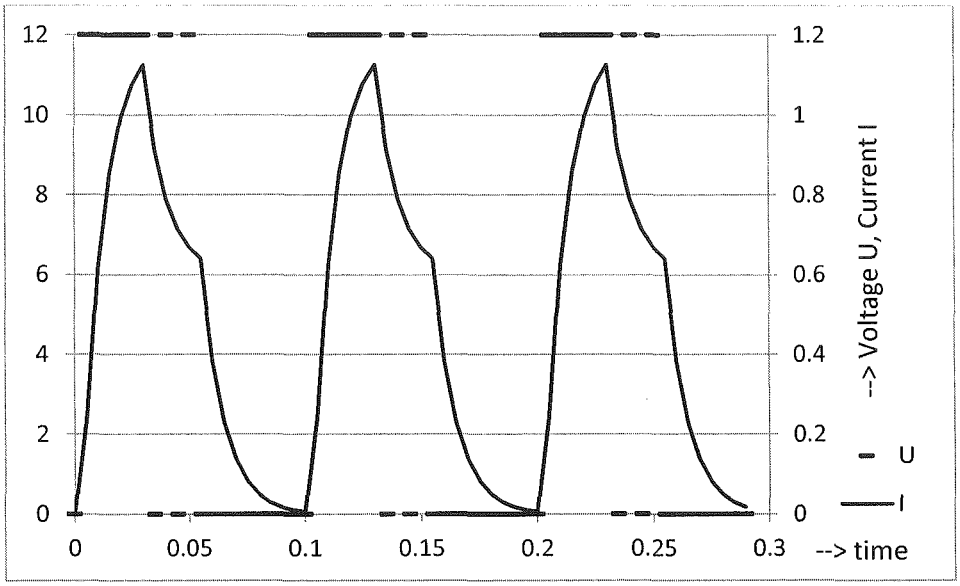
FIG. 5 shows the profile of the voltage and of the current for a characteristic actuation with a manipulation of the flank gradient.

During operation, the controlled electrical voltage or the regulated electrical current for the supply to the electromagnet 2 has a pulsed profile with respect to time, as illustrated in FIG. 5. Said pulsed profile may have superposed on it an additional pulse width modulation in order to reduce the electrical power according to requirements and manipulate the harmonic content and the flank gradient of the pulses. Here, the base frequency determines the delivery rate of the reciprocating-piston pump 1, the associated pulse-to-pause ratio is coordinated with the pressure at the outlet 8 of the reciprocating-piston pump 1, and the flank gradients of the pulses are coordinated with the demands on the liquid flow through the cylinder 10.

LIST OF REFERENCE NUMERALS

1. Reciprocating-piston pump
2. Electromagnet
3. First displacement body chamber
4. Armature chamber
5. First check valve
6. Second valve
7. Inlet
8. Outlet
9. Piston
10. Cylinder
11. Bearing gap
11'. Depressions
12. Armature piston
13. First transverse bore
14. Second transverse bore
15. Longitudinal bore
16. Third transverse bore
17. Second longitudinal bore
21. First bearing zone
22. Second bearing zone
23. Third bearing zone
29. Bore
30. Transverse bore
31. Fluid-conducting ducts The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electromagnetically driven reciprocating-piston pump comprising:

a piston which displaces fluid and which supports an armature piston of an electromagnet and which, is sealingly borne in a cylinder; and one or more depressions defined in at least one of two bearing surfaces in a bearing gap between the piston and the cylinder, wherein each depression extends over a part of a length of the piston or of the cylinder and wherein the depressions are of helical form to cover a part of the bearing surface, and wherein the depressions are connected via a low-resistance fluidic connection, by a transverse bore, to a valve and are connected via a further low-resistance fluidic connection to an armature chamber and are traversed at least partially by a flow of the fluid which is delivered by the piston acting in interaction with the cylinder for an output rate of the reciprocating-piston pump, wherein the delivery flow of the reciprocating-piston pump is conducted entirely through the transverse bore adjacent to the valve to depressions in the surface of the piston or of the cylinder, then through a second transverse bore into a longitudinal bore in the piston, and then through a third transverse bore adjacent to and into the armature chamber, wherein the depressions do not extend into the armature chamber and do not extend into a displacement body chamber.

2. A method for operating a reciprocating-piston pump according to claim 1, wherein electrical voltage or electrical current for supply to the electromagnet has a repeating pulsed profile with respect to time which additionally exhibits discontinuity by pulse width modulation, wherein a base frequency determines a delivery rate, an associated pulse-to-pause ratio is coordinated with pressure at an outlet of the pump, and flank gradients of rising and falling flanks of associated pulses are coordinated with demands on fluid flow through the bearing surfaces in the cylinder.

3. An electromagnetically driven reciprocating-piston pump comprising:

a piston which displaces fluid and which supports an armature piston of an electromagnet and which, is sealingly borne in a cylinder; and one or more depressions defined in at least one of two bearing surfaces in a bearing gap between the piston and the cylinder, wherein each depression extends over a part of a length of the piston or of the cylinder and wherein the depressions are of helical form to cover a part of the bearing surface, and wherein the depressions are connected via a low-resistance fluidic connection, by a transverse bore, to a valve and are connected via a further low-resistance fluidic connection to an armature chamber and are traversed at least partially by a flow of the fluid which is delivered by the piston acting in interaction with the cylinder for an output rate of the reciprocating-piston pump, wherein the delivery flow of the reciprocating-piston pump is conducted through the transverse bore to depressions in the surface of the piston or of the cylinder, then through a second transverse bore in the cylinder and through further fluid-conducting ducts to the armature chamber.

4. The reciprocating-piston pump according to claim 3, wherein the delivery flow of the reciprocating-piston pump is conducted partially through the transverse bore to depressions in the surface of the piston or of the cylinder, then through the second transverse bore in the cylinder and through further fluid-conducting ducts to the armature chamber, wherein another partial amount of the delivery flow of the reciprocating-piston pump is conducted from a first longitudinal bore through a third transverse bore into the armature chamber, and wherein the size of said third transverse bore determines the apportionment of the partial flows.

5. A method for operating a reciprocating-piston pump according to claim 3, wherein electrical voltage or electrical current for supply to the electromagnet has a repeating pulsed profile with respect to time which additionally exhibits discontinuity by pulse width modulation, wherein a base frequency determines a delivery rate, an associated pulse-to-pause ratio is coordinated with pressure at an outlet of the pump, and flank gradients of rising and falling flanks of associated pulses are coordinated with demands on fluid flow through the bearing surfaces in the cylinder.

6. An electromagnetically driven reciprocating-piston pump, comprising:

a cylinder having a cylinder bearing surface;

a piston having a piston bearing surface and configured to displace a liquid, the piston received in the cylinder to form a bearing gap between the cylinder bearing surface and the piston bearing surface, the piston defining a longitudinal bore;

at least one depression defined in at least one of the cylindrical bearing surface and the piston bearing surface, where the at least one depression extends along a length of the piston or the cylinder in the form of a spiral shaped groove;

a valve located at an end of the piston;

an armature chamber spaced apart from the valve and positioned relative to the piston;

a first transverse bore through the piston to the longitudinal bore and located adjacent the valve; and a second transverse bore through the piston to the longitudinal bore and located adjacent the armature chamber, wherein a fluidic connection is formed between the valve and the armature chamber at least partially by a flow of the liquid delivered by the piston acting in interaction with the cylinder by way of the at least one depression, the first transverse bore, the second transverse bore, and the longitudinal bore, wherein a first fluid path through the reciprocating-piston pump extends from the valve through the first transverse bore to the at least one depression to a third transverse bore in the cylinder and through further fluid-conducting ducts to the armature chamber; a second fluid path through the reciprocating-piston pump extends from the valve through the longitudinal bore to the second transverse bore to the armature chamber.

7. A method for operating a reciprocating-piston pump according to claim 6, wherein electrical voltage or electrical current for supply to the electromagnet has a repeating pulsed profile with respect to time which additionally exhibits discontinuity by pulse width modulation, wherein a base frequency determines a delivery rate, an associated pulse-to-pause ratio is coordinated with pressure at an outlet of the pump, and flank gradients of rising and falling flanks of associated pulses are coordinated with demands on fluid flow through the bearing surfaces in the cylinder.

* * * * *